United States Patent [19]

Baus et al.

[11] Patent Number: 4,974,492

[45] Date of Patent: Dec. 4, 1990

[54] AMMUNITION MAGAZINE

[75] Inventors: Rudiger Baus, Vellmar; Gottlieb Ruttgerodt, Kassel; Claus-Dieter Ullrich, Ahnatal, all of Fed. Rep. of Germany

[73] Assignee: Wegmann & Co. GmbH, Kassel, Fed. Rep. of Germany

[21] Appl. No.: 463,046

[22] Filed: Jan. 11, 1990

[30] Foreign Application Priority Data

Jan. 17, 1989 [DE] Fed. Rep. of Germany ..... 3901173

[51] Int. Cl.[5] ..... F41A 9/72

[52] U.S. Cl. ..... 89/046; 89/34

[58] Field of Search ..... 89/45, 46, 34, 33.02, 89/33.1

[56] References Cited

U.S. PATENT DOCUMENTS

| | | | |
|---|---|---|---|
| 3,180,224 | 4/1965 | Linke | 89/34 |
| 3,242,814 | 3/1966 | Carlsson | 89/46 |
| 3,320,857 | 5/1967 | Carlsson | 89/34 |
| 4,562,765 | 1/1986 | Grunewald et al. | 89/34 |
| 4,580,482 | 4/1986 | Grunewald et al. | 89/34 |

FOREIGN PATENT DOCUMENTS

| | | | |
|---|---|---|---|
| 2413983 | 10/1979 | Fed. Rep. of Germany | 89/33.02 |
| 660891 | 7/1929 | France | 89/46 |
| 400238 | 1/1942 | Italy | 89/34 |
| 963328 | 7/1964 | United Kingdom | 89/34 |

*Primary Examiner*—Charles T. Jordan
*Assistant Examiner*—Stephen Johnson
*Attorney, Agent, or Firm*—Sprung, Horn, Kramer & Woods

[57] ABSTRACT

An ammunition magazine for stowing large-caliber ammunition in a miltiary tank. The rack has an intake rack comprising rows of essentially horizontal intake tubes positioned one above and next to another for accommodating shells. The rack can be lowered into the tank's ammunition bunker from above. The intake rack is suspended at the top from an antivibration and shock-absorbing suspension on the bottom of an impact-resistant roofing plate that fits into an opening in the roof of the tank and can be locked into the opening along the edge. The rack has at least one centering pin at the bottom that fits into a receptacle on a base secured to the floor of the ammunition bunker when the rack is lowered in.

12 Claims, 7 Drawing Sheets

FIG. 6
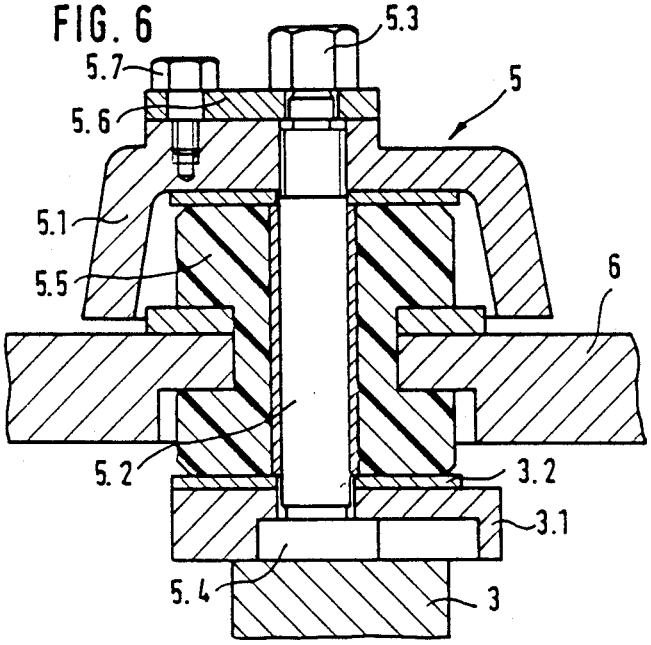
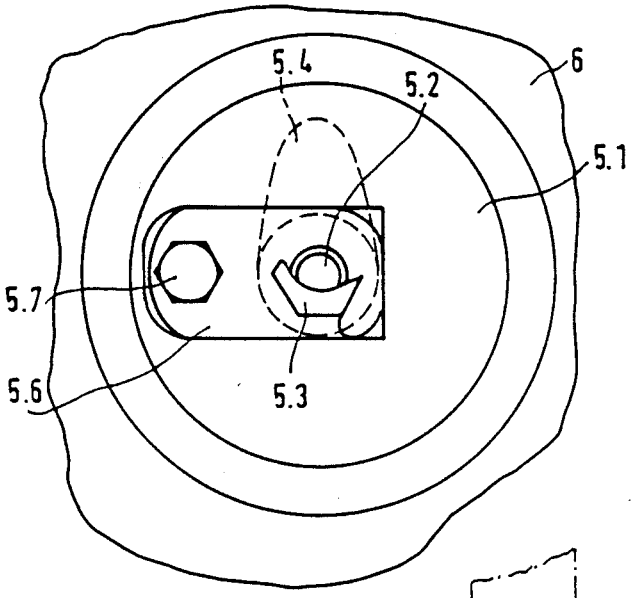
FIG. 7
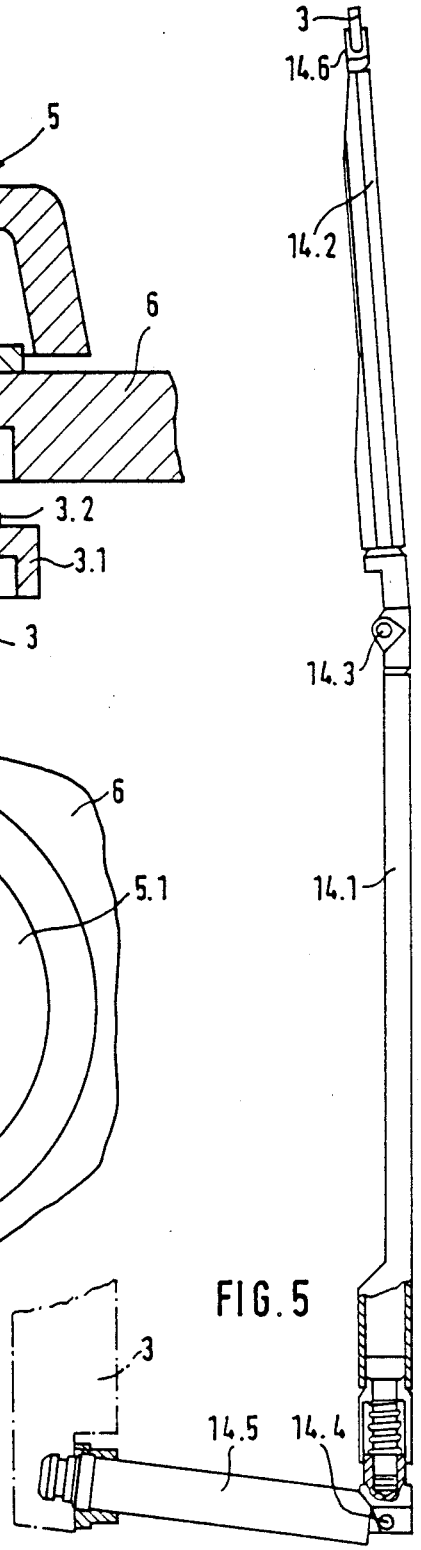
FIG. 5

AMMUNITION MAGAZINE

BACKGROUND OF THE INVENTION

The invention concerns an ammunition magazine for stowing large-caliber ammunition in a military tank with an intake rack comprising rows of essentially horizontal intake tubes positioned one above and next to another for accommodating shells, whereby the rack can be lowered into the tank's ammunition bunker from above.

An ammunition magazine of this type is described in U.S. Pat Nos. 4 562 785 and 4 580 482 for example. The magazine described in the latter document is composed of several adjacent intake racks that can be lowered empty into a tank bunker from above and then screwed together. The magazine is conventionally loaded by the crew once the racks have been secured.

This component-by-component introduction of the magazine takes a considerable amount of time, inasmuch as the unfired shells must be removed again once the racks are in place, resulting in multiple stowing and unstowing. The shells can also sustain damage by being shifted around so much, and some can even eventually become unusable.

SUMMARY OF THE INvENTION

The object of the invention is to improve an ammunition magazine of the aforesaid type to the extent that it can be filled outside the tank and lowered full into the tank.

This object is attained in accordance with the invention by the improvement wherein the intake rack is suspended at the top from an antivibration and shock-absorbing suspension on the bottom of an impact-resistant roofing plate that fits into an opening in the roof of the tank and can be locked into the opening along the edge and wherein the rack has at least one centering pin at the bottom that fits into a receptacle on a base secured to the floor of the ammunition bunker when the rack is lowered in.

The ammunition magazine in accordance with the invention accordingly functions as a replaceable magazine for large-caliber ammunition. Several magazine components, each consisting of an intake rack and a roofing plate, are always available and can be filled outside the tank and lowered full into the tank. Once the magazine is in place, the roofing plate is locked into position in the hole in the roof of the tank, sealing the roof and making it impact-resistant. As will be described later herein with reference to one embodiment of the invention, several, two for example, such magazine components can be lowered into one tank.

One major advantage of the ammunition magazine in accordance with the invention is that ammunition is much easier to stow outside a tank.

Since the intake racks are suspended from the roofing plate on an antivibration and shock-absorbing suspension, they can be stored outside the tank in containers that do not themselves require shock absorbers, satisfying the rigid specifications for storing and conveying ammunition without additional engineering. The transport and hoist do not need to be heavier than usual because the additional weight of the roofing plate is compensated for by reducing the weight of other components of the magazine.

Since the magazine is also suspended from the antivibration and shock-absorbing suspension inside the tank and is only centered with respect to the base without resting on it, the tank itself does not require additional shock absorbers.

When the tank has an ammunition bunker that tapers upward, additional, essentially horizontal intake tubes can be secured to the base at the side and next to where the intake rack is lowered in and below the tapering section of the bunker wall. The additional tubes are filled individually.

The additional intake tubes at the side and next to where the intake rack is lowered in can pivot into the path of the rack in a horizontal plane and against the force of a spring.

Any intake tube in the intake rack that is in the path of an additional intake tube on the base when it swings out can be cut away at the side that faces the additional tube.

These measures facilitate filling and emptying the additional tubes, which can then be pivoted back into their original position to prevent malfunction and allow the intake racks to be lowered in smoothly.

The base can be secured to the floor of the ammunition bunker by way of buffers that act at least horizontally.

The intake rack can be attached horizontally to the base by way of the centering pin or pins.

The suspension between the intake rack and the roofing plate can include a mechanism for adjusting the horizontal position of the rack in relation to the plate. As will be described in greater detail later herein, the ammunition bunkers in known tanks can have two adjacent magazines, and the two openings in the roof do not have to be symmetrical to the longitudinal midline of the vehicle. The mechanism in accordance with the invention on the other hand makes it possible to get along with only one type of magazine.

The suspension can include a rotating suspension bolt that extends through the roofing plate and through a buffer secured to the roofing plate, whereby the outer end of the bolt has a structure providing a purchase for an adjusting tool and the inner end has a toe that pivots horizontally around the axis of the bolt and engages a bearing that is displaced horizontally along a track when the toe pivots. The position of the roofing plate can accordingly be adjusted in relation to that of the intake rack even subject to tension, just before the magazine is lowered in for instance.

Rings that provide a purchase for a hoist can be distributed over the outside of the roofing plate.

Guides in the form of essentially vertical tracks that facilitate lowering the intake racks in can be positioned in front of and behind, in terms of the intake tubes, the intake rack and outside of where the shells are stowed in the tubes, with at least the guide on side of the stack that the shells are removed from capable of disassembly.

The guide that can be disassembled can consist of two rods attached together by a hinged joint, whereby one rod has an open cross-section, folding down around and fitting against the other rod and whereby the other end of the latter rod is fastened by way of an articulation to the bottom edge of the intake rack and the other end of the former rod is fastened by way of a releasable fastener to the upper edge of the rack.

The rod that is fastened to the bottom edge of the intake rack is secured to an intermediate that can be shifted along the intake rack.

The guides protect the shells while the intake racks are being lowered into the tank.

BRIEF DESCRIPTION OF THE DRAWINGS

One embodiment of an ammunition magazine in accordance with the invention will now be described with reference to the drawings, wherein FIG. 5 is a larger-scale side view of the guide at the end of the magazine illustrated in FIGS. 2 through where the shells are removed, FIG. 6 is a section of the suspension between the roofing plate and the intake rack of the magazine illustrated in FIGS. 2 through 4, and FIG. 7 is a top view of the suspension illustrated in FIG. 6.

DETAILED DESCRIPTION OF THE INVENTION

Figure 1:
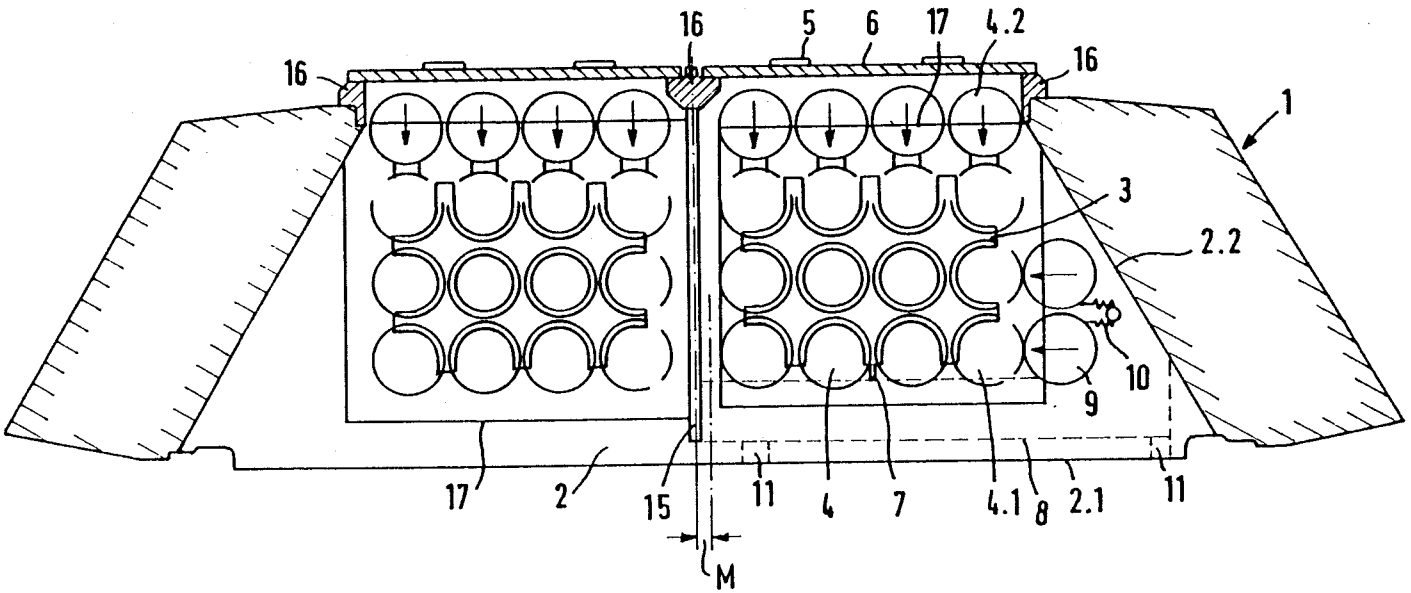
FIG. 1 is a highly schematic section through the turret of a tank with two ammunition magazines.
Figure 2:
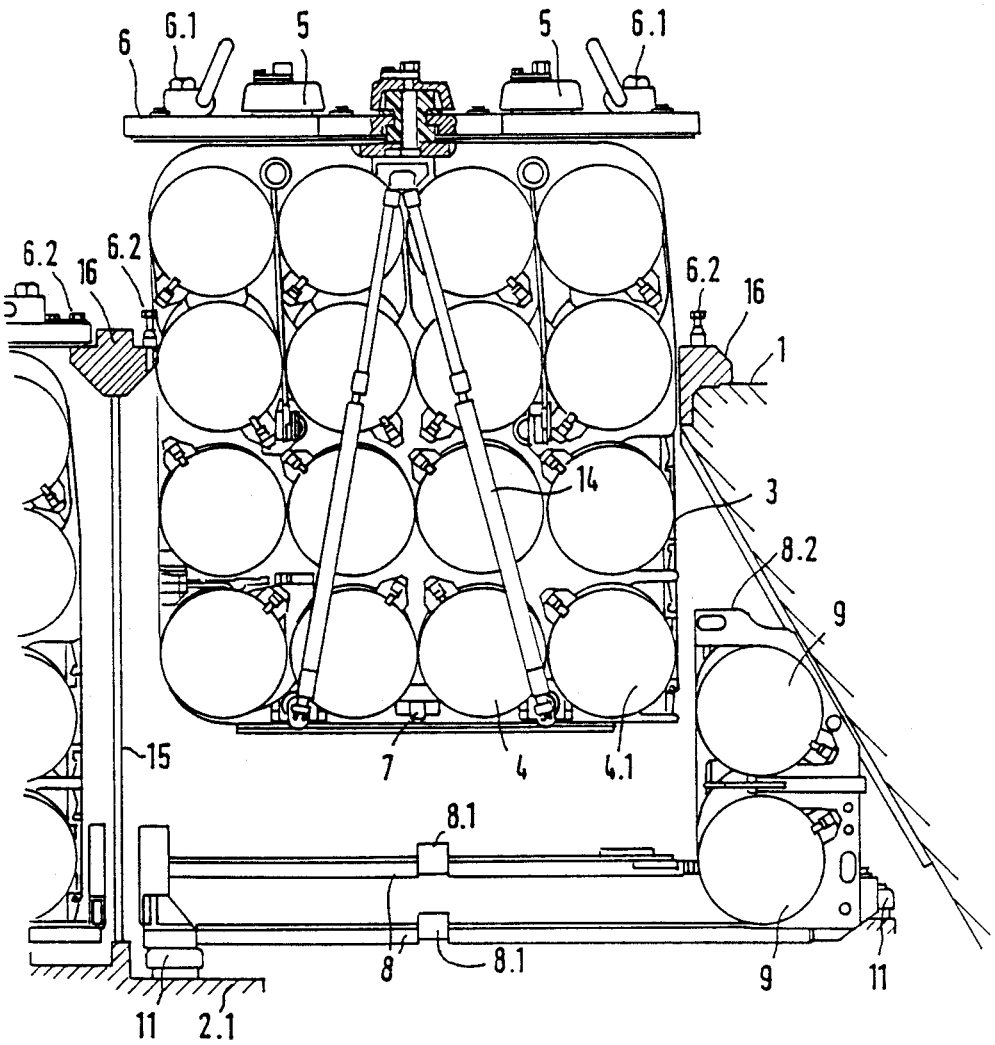
FIG. 2 is a slightly larger-scale detail of a magazine being lowered into the tank illustrated in FIG. 1, FIG. *2a* is a larger-scale section along the line II*a*—II*a* in FIG. *2b* in the vicinity of the additional intake tubes, FIG. *2b* is a larger-scale side view of the additional intake tubes.
Figure 2A:
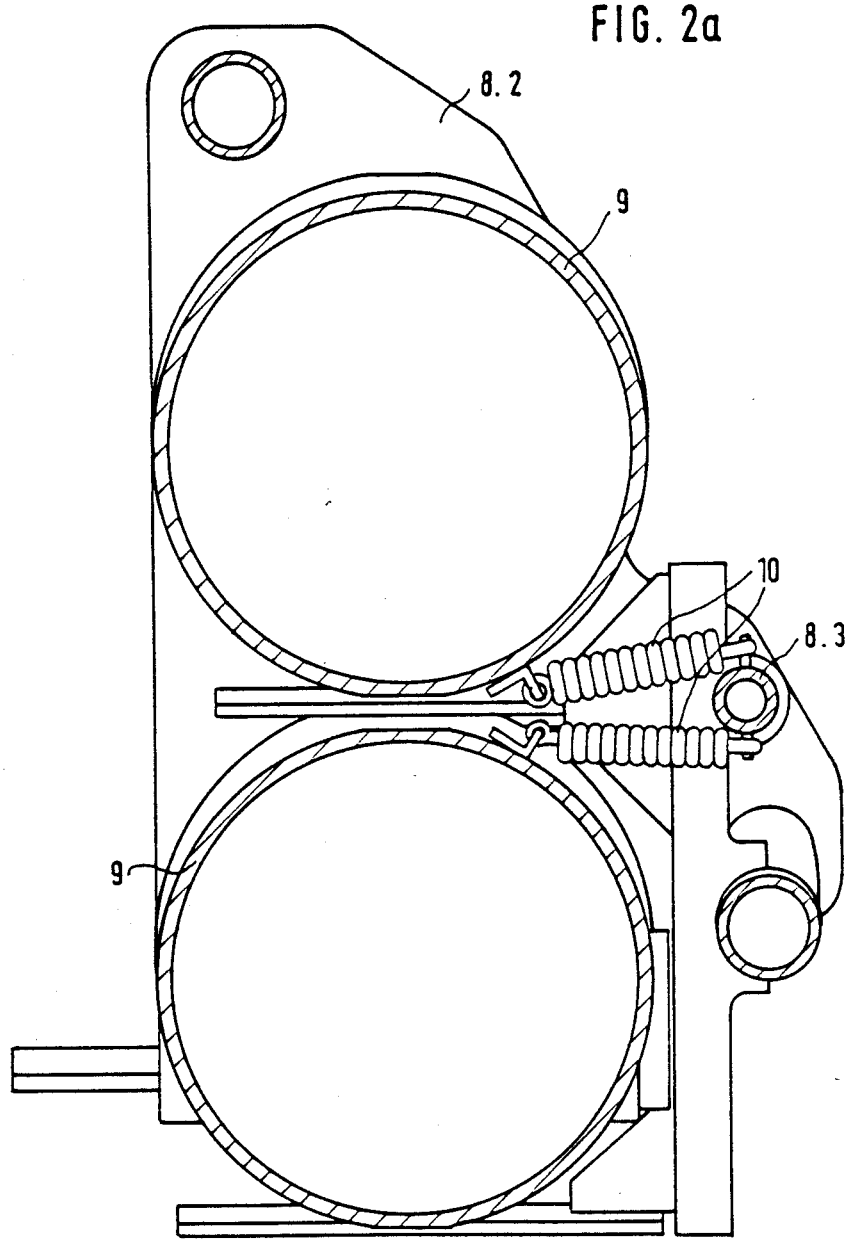
Figure 2B:
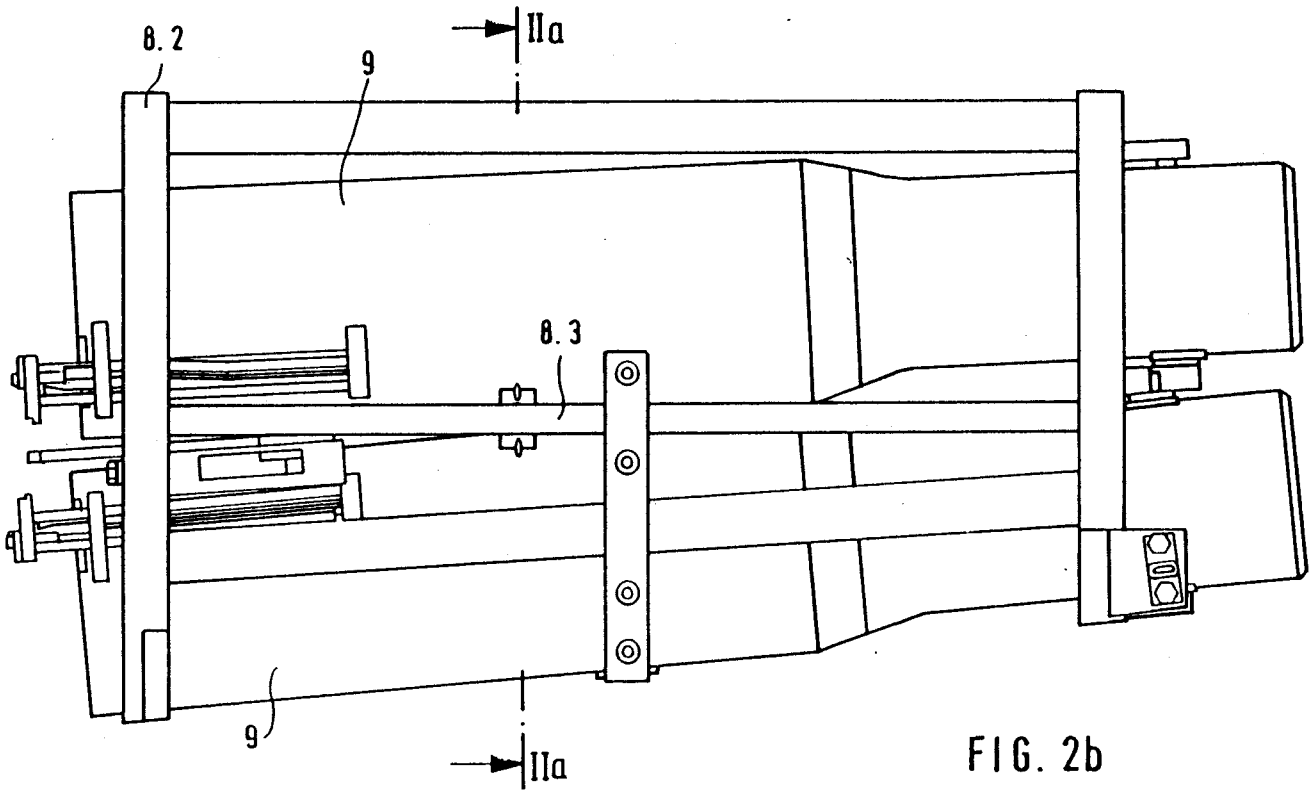
Figure 3:
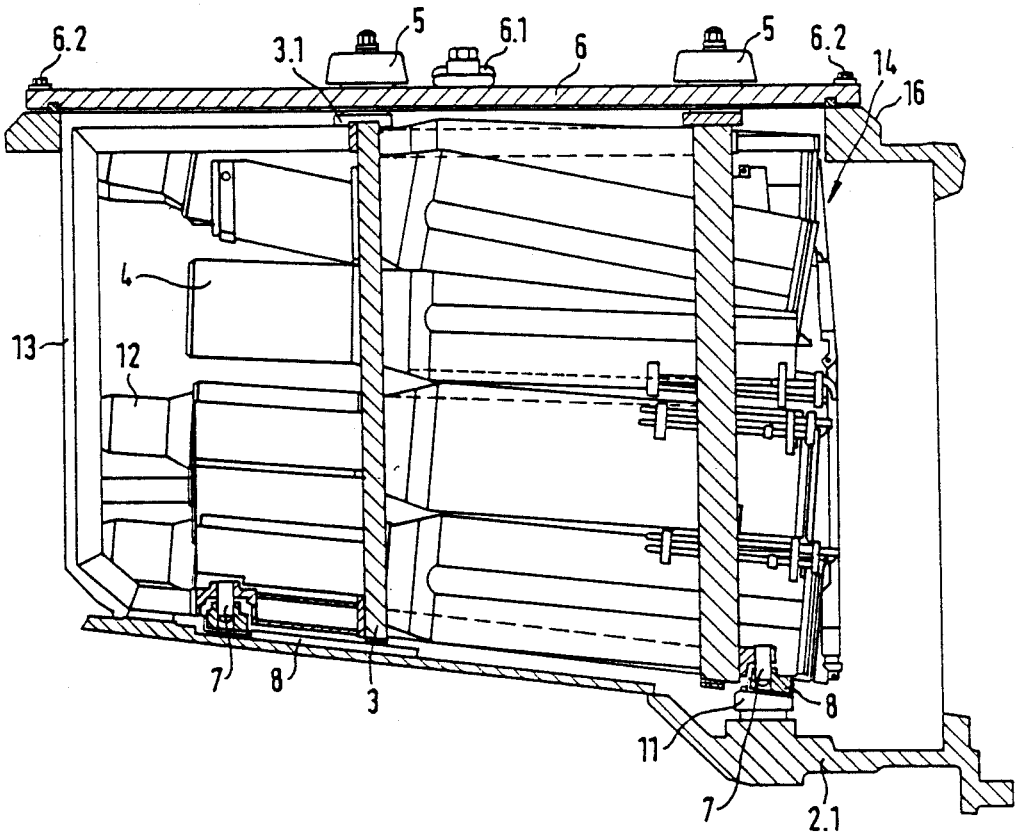
FIG. 3 is a longitudinal section through the magazine illustrated in FIG. 2 in position.
Figure 4:
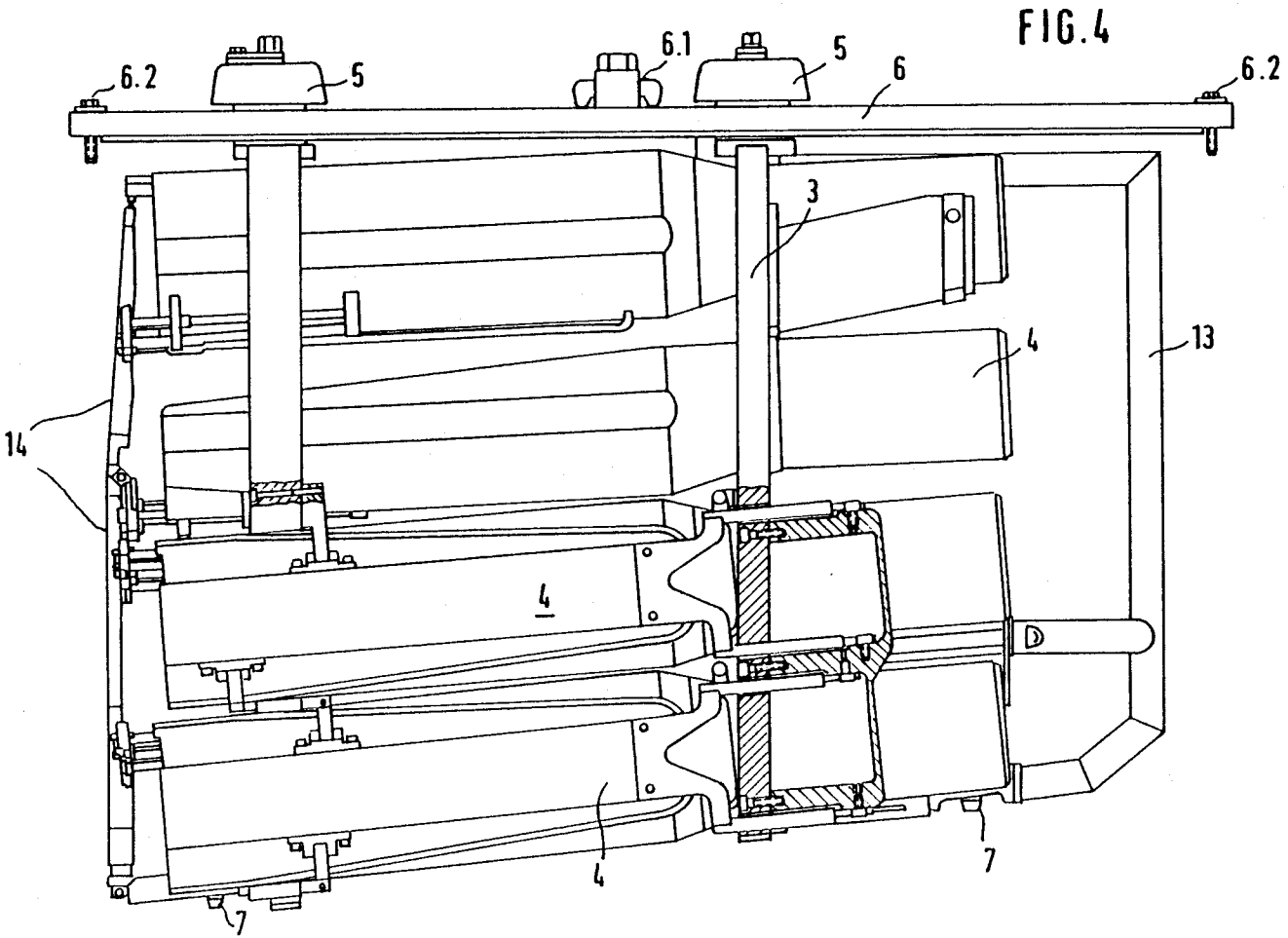
FIG. 4 is a side view of the magazine outside of the tank at a scale slightly larger than that of FIGS. 2 and 3.

The basic principle behind the ammunition magazine in accordance with the invention will now be described with reference to FIG. 1. The schematically illustrated turret 1 of a military tank accommodates an ammunition bunker 2 with sloping walls 2.2 that provide it with an upward-tapering cross-section. At the top of turret 1 are two openings, slightly asymmetrical to the central axis M of the turret. Between the openings is a partition 15 that divides the interior into two compartments. Two magazine components can be lowered in through the holes from above. Each component constitutes an intake rack 3 comprising rows of essentially horizontal intake tubes 4 positioned one above and next to another and accommodating unillustrated shells. Each intake rack 3 is suspended at the top from a suspension 5, which will be described in detail later herein, on the bottom of an impact-resistant roofing plate 6 that rests on supports 16 on the roof of tank 1 and accordingly closes off the openings. Since the passages 17 between bunker 2 and the unillustrated cockpit are small, the intake tubes 4.2 in the first row swing down in a known (U.S. Pat. No. 4,562,765) way to facilitate access to the shells stowed in them.

At the bottom of intake rack 3, centering pins 7, which will be described in greater detail later herein, engage a bearing on a base 8 secured through vibration-reducing buffers 11 to the floor 2.1 of the bunker. To better exploit the space at the side and below sloping walls 2.2 as well, base 8 also accommodates additional intake tubes 9 out of the path of intake rack 3. Only the additional tubes on the right are illustrated. The tubes pivot horizontally into the vicinity of passages 17 against the force of springs 10, facilitating access to them. To permit them to pivot in, the intake tubes 4.1 in the vicinity of additional intake tubes 9 are cut away at the side that faces the additional tubes, which can accordingly completely enter the path of the rack. Springs 10 ensure that additional intake tubes 9 will retract into their non-operational position, preventing errors and malfunctions in lowering and lifting the magazine in and out.

The relationships that characterize the embodiment in question will be more evident from FIGS. 2 through 7.

Base 8 is mounted, preferably horizontally resilient, on buffers 11 and is also capable of accommodating additional intake tubes 9.

When an intake rack 3 is lowered in, the centering pins 7 more or less at the center engage matching bearings 8.1 on base 8, limiting any oscillations that might occur due to suspension 5. Securing the racks with centering pins 7, of which each rack has two as will be evident from FIGS. 3 and 4, will prevent relative motions between the intake tubes 4 in stack 3 and the additional intake tubes 9 in base 8.

FIG. *2a* illustrates how additional intake tubes 9 are accommodated in a section 8.2 of base 8 positioned below wall 2.2. One end of each of the springs 10 that restore additional intake tubes 9 to their non-operational position is secured to the surface of the additional tubes and the other end by way of an intermediate 8.3 to base section 8.2.

The suspension 5 on which intake rack 3 hangs on roofing plate 6 is illustrated in detail in FIGS. 6 and 7. FIG. 6 is a section through the suspension at a right angle to the ammunition magazine.

Each suspension unit comprises a rotating suspension bolt 5.2 that extends through a protective cap 5.1 and a buffer 5.5 mounted in roofing plate 6. The top of suspension bolt 5.2 is a hexagon that accommodates an adjustment tool. At the bottom of the bolt is a toe 5.4 that engages a bearing 3.1 secured to intake rack 3 and sliding along a track 3.2. The positioning surfaces in bearing 3.1 force intake rack 3 horizontally over suspension bolt 5.2 when suspension bolt 5.2 is rotated. Once a particular position has been attained, it can be maintained with a baffle 5.6 secured by a screw 5.7.

The suspension 5 in accordance with the invention is not only antivibration and shock-absorbing but also allows the position of intake rack 3 to roofing plate 6 to be adjusted even when the components are subject to tension, and the magazine unit consisting of intake rack 3 and roofing plate 6 can be adjusted to the asymmetrical relation between the two openings in turret 1.

Roofing plate 6 is secured to supports 16 with screws 6.2.

To prevent damaging the shells 12 stowed in intake tubes 4 while the intake rack is being lowered into and lifted out of the tank, guides in the form of tracks 13 and 14 are positioned in front of and behind, in terms of the longitudinal axis of the tubes, the intake points, the points, that is, where the tips and bases of the shells are supported. The guides are essentially vertical or at a slight angle to the vertical and prevent the tips and bases of the shells from ever coming into contact with the edge of the opening in turret 1. The guide 13 in front of intake rack 3 is a rod that is rigidly secured to intake rack 3, and the guide 14 at the rear of the rack, the side from which the shells are removed, is a removable folding rod comprising as will be evident from FIG. 2 two mutually articulated rods that extend at a slight angle to each other and to the vertical. Guide 14 is illustrated in greater detail in FIG. 5. Guide 14 comprises two shorter rods 14.1 and 14.2 connected by a hinged joint 14.3. The rod 14.2 at the top of FIG. 5 has a C-shaped cross-section, and lower rod 14.1 is round. It is accordingly easy to fold guide 14 together at hinged joint 14.3. Rod 14.2 is attached at its upper and free end to the upper edge of intake rack 3 by way of a fastener 14.6, and the lower and free end of rod 14.1 by Way of an articulation 14.4 to an intermediate 14.5 fastened to the bottom edge of intake rack 3. Intermediate 14.5 can telescope, and its point of attachment to intake rack 3 can be shifted toward the transverse midpoint of the rack. This measure makes it possible to release fastener 14.6, fold up guide 14, and insert it along the bottom of intake rack 3 until there are no more problems removing the shells.

Once an intake rack 3 has been lifted out of turret 1, it can be stored in an unillustrated way in containers with openings at the top that also match roofing plate 6. The rack will then of course be suspended from the plate by way of the antivibration and shock-resistant suspension 5 exactly as in the turret, and the container itself will need no suspension.

It will be appreciated that the instant specifications and claims are set forth by way of illustration and not limitation, and that various modifications and changes may be made without departing from the spirit and scope of the present invention.

What is claimed is:

1. In a military tank having an ammunition bunker with an opening at a top portion thereof and a floor, and an ammunition magazine for stowing shells including an intake rack comprising rows of generally horizontal intake tubes positioned one above and next to another for accommodating shells and wherein the intake rack is lowerable into the ammunition bunker from above, the improvement comprising an impact resistant roofing plate disposed over the opening, an antivibration and shock-absorbing suspension connected to a bottom portion of the impact-resistant roofing plate for suspending the intake rack, means locking the roofing plate into the opening along an edge of the roofing plate, first means for securing the intake rack to the floor comprising at least one centering pin at a bottom portion of the rack and a receptacle on a base for receiving the centering pin when the intake rack is lowered into the ammunition bunker and second means for securing the base to the floor.

2. The tank as in claim 1, wherein the ammunition bunker has side walls that taper upward, third means for securing essentially horizontally additional intake tubes to the base below the tapering side walls and next to the intake rack.

3. The tank as in claim 2, wherein the third securing means comprises means for pivoting the additional intake tubes into a path of the intake rack in a horizontal plane and against a force of a spring.

4. The tank as in claim 3, wherein an intake tube of said intake tubes in the intake rack in a pivot path of the additional intake tubes has a cut away side.

5. The tank as in claim 1, wherein the second means for securing the base to the floor comprises buffers that act at least horizontally.

6. The tank as in claim 1, wherein the intake rack is attached to the base by the centering pin.

7. The tank as in claim 1, wherein the antivibration and shock-absorbing suspension between the intake rack and the roofing plate includes a mechanism for adjusting a horizontal position of the intake rack in relation to the roofing plate.

8. The tank as in claim 7, wherein the antivibration and shock-absorbing suspension further includes a rotating suspension bolt that extends through the roofing plate and through a buffer secured to the roofing plate, wherein an outer end of the bolt has means forming a purchase and an inner end of the bolt has a toe that pivots horizontally around an axis of the bolt and engages a bearing that is displaced horizontally along a track when the toe pivots.

9. The tank as in claim 1, further comprising rings forming a purchase and distributed over an outside surface of the roofing plate.

10. The tank as in claim 1, further comprising guide means for the intake rack comprising essentially vertical tracks positioned in front of and behind the intake rack in relation to the intake tubes and outside of where said shells are stowed in the tubes.

11. The tank as in claim 10, wherein a part of the guide means are disassemblable and include two rods attached together by a hinged joint, wherein one rod has an open cross-section, folding down around and fitting against the other rod, and wherein one end of the other rod is fastened by an articulation to a bottom edge of the intake rack and the one end of the one rod is fastened by a releasable fastener to an upper edge of the intake rack.

12. The tank as in claim 11, wherein the rod fastened to the bottom edge of the intake rack is secured to an intermediate member shiftable along the intake rack.

* * * * *